United States Patent [19]

Wright

[11] 3,972,469

[45] Aug. 3, 1976

[54] BAG CLOSURE

[76] Inventor: Charles E. Wright, 80 Lynwood Ave., Toronto, Ontario, Canada

[22] Filed: Apr. 3, 1975

[21] Appl. No.: 564,791

[30] Foreign Application Priority Data

Feb. 28, 1975 Canada ..... 221290

[52] U.S. Cl. ..... 229/62; 24/30.5 P

[51] Int. Cl.[2] ..... B65D 33/16

[58] Field of Search ..... 229/62; 150/3; 24/16 PB, 30.5 W, 30.5 P

[56] References Cited

UNITED STATES PATENTS

| | | | |
|---|---|---|---|
| 3,568,259 | 3/1971 | Gaudlitz | 24/30.5 PB |
| 3,673,639 | 7/1972 | Driscoll | 24/16 PB |

FOREIGN PATENTS OR APPLICATIONS

| | | | |
|---|---|---|---|
| 1,276,833 | 10/1961 | France | 24/16 PB |
| 652,152 | 1/1963 | Italy | 24/30.5 P |

*Primary Examiner*—Stephen P. Garbe

[57] ABSTRACT

A bag closure securable around the neck of a flexible bag has an elongated strip of material with opposite end portions connected by a pair of laterally spaced flexible ribbon portions. The strip is of synthetic plastic material, and the thickness of the connecting ribbon portions is substantially less than the thickness of the end portions. The ribbon portions are substantially molecularly oriented in the direction of their length, and the end portions are not so molecularly oriented.

6 Claims, 5 Drawing Figures

BAG CLOSURE

This invention relates to closures for flexible bags, and more particularly to closures which are secured around the neck of the bag.

Many such closures for flexible bags are known, ranging from the simplest in which a piece of string or like flexible element is tied around the neck, to more sophisticated arrangements which engage the neck of the bag. Practical considerations concerned with such closures include their cost, the ease with which they can be attached to a bag or removed therefrom, how securely they close the neck of the bag, and their appearance. When such closures are used with food-containing bags sold in stores for domestic use, all these features are particularly important.

It is therefore an object of the invention to provide such a closure securable to the neck of the flexible bag which possesses the features mentioned to an adequate extent.

According to the invention, a bag closure comprises an elongated strip of material having opposite end portions connected by a pair of laterally spaced flexible ribbon portions. In use, the ribbon portions extend around the neck of a bag, and have their opposite ends adjacent to one another, with one pair of ends passing between the opposite pair of ends and with the end portions being adjacent to one another and extending in opposite directions.

The strip may be of synthetic plastic material, and the thickness of the connecting ribbon portions may be substantially less than the thickness of the end portions. The ribbon portions may be substantially molecularly oriented in the direction of their length, to provide additional strength, with the end portions not being so molecularly oriented. The molecular orientation and reduction in thickness of the ribbon portions may be produced by stretching. As explained later, this also results in a saving of material.

Each end portion may have a longitudinally extending series of apertures therein to provide an improved manual grip on the end portions. The end portions may have recessed end edges between the ribbon portions, so as to facilitate passage of an end portion between the ribbon portions when the closure is being secured around the neck of a bag. The end portion may have a tapered free end to also facilitate its passage between the ribbon portions.

One embodiment of the invention will now be described by way of example, with reference to the accompanying drawings, of which:

Figure 1:
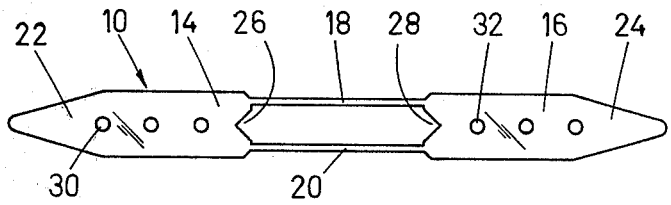
FIG. 1 is a front view of the closure.
Figure 2:
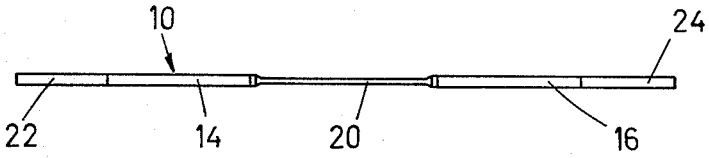
FIG. 2 is a side view of the closure.
Figure 3:
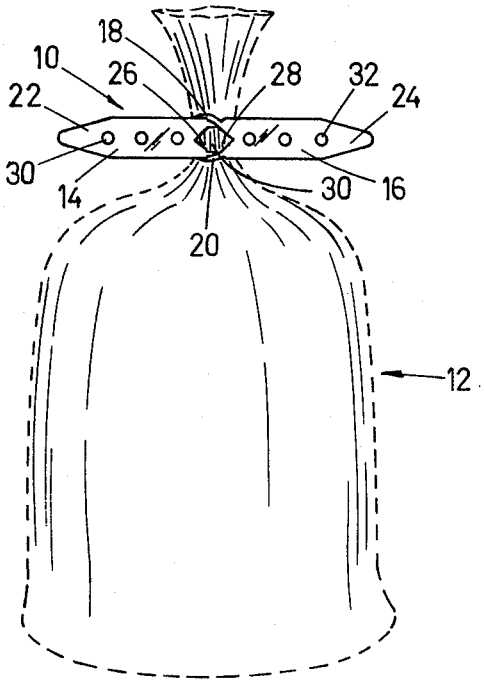
FIG. 3 is a front view of the closure secured around the neck of a flexible bag.

Referring first to FIGS. 1 to 3 of the drawings, a closure 10 for a flexible plastic bag 12 comprises a strip of synthetic plastic material, for example, polyethelene or polypropylene, with opposite end portions 14,16 of medium flexibility connected by a pair of laterally spaced ribbon portions 18,20 of higher flexibility. The ribbon portions 18,20 are substantially molecularly oriented in the direction of their length, but the end portions 14,16 are not so oriented.

The end portions 14,16 are thicker than the ribbon portions 18,20 and consequently have less flexibility than the ribbon portions. The medium flexibility of the end portions 14,16 is sufficient to enable them to be bent for the purpose of securing the closure 10 to the bag and removing it therefrom, as will be described later. The free ends 22,24 of the end portions 14,16 are tapered and the end portions 14,16 have end edges 26,28 between the ribbon portions 18,20 which are recessed in the form of a V-shaped notch. Also, each end portion 14,16 has a longitudinally extending series of circular apertures 30,32 respectively.

To secure the closure 10 to the neck 30 of the plastic bag 12, the closure 10 is first placed behind the bag 12, and the end portion 16 is brought around to the front of the bag 12, wrapping the ribbon portions 18,20 around the neck 30 with the end portion 16 directed away from the neck 30, and with the end edge 28 adjacent to the neck 30, as shown in FIG. 3. The other end portion 14 then brought around to the front of the bag 12, in the opposite direction to the previous wrapping movement of end portion 16, to further wrap the ribbon portions 18,20 around the neck 30, and the tapered leading end 22 of the end portion 14 is passed between the ribbon portions 18,20 adjacent to the end edge 26 of the end portion 16. The notched end edge 28 facilitates the passing of the tapered end 22 between the adjacent ribbon portions 18,20.

The end portions 14,16 are then gripped between the thumb and forefinger of each hand respectively and are pulled in opposite directions, until the end portion 14 has been pulled completely through the space between the ribbon portions 18,20 as shown in FIG. 3. The apertures 30,32 in the end portions 14,16 facilitate the gripping of the end portions 14,16 between thumb and forefinger by reducing the likelihood of their slipping over the surface of the plastic material. During the pulling of the end portion 14 through the space between the ribbon portions 18,20, the neck 30 of the bag is compressed by the ribbon portions 18,20. When the end portions 14,16 are released, after the end portion 14 has been pulled through in the manner described, the neck 30 of the bag then expands somewhat to tension the ribbon portions 18,20. This results in the ends of the ribbon portions 18,20 adjacent to the end portion 16 being forced towards one another into engagement with the opposite ends of the ribbon portions 18,20 adjacent to the end portion 14, thereby preventing the end portion 14 from reversing its movement after it has been pulled through the space between the ribbon portions 18,20. The closure is therefore held firmly in place on the neck 30 of the bag 12. It will be easily understood that the higher flexibility of the ribbon portions 18,20 enables them to be readily wrapped around the neck 30 and that the more medium flexibility of the end portions 14,16 facilitates the insertion of one end portion between the ribbon portions adjacent the other end portion, the medium flexibility of the end portions enabling them to be resiliently bent by a certain amount for this purpose.

It can be seen from FIG. 3 that the closure presents an attractive appearance on the neck 30 of the bag 32, its appearance in fact somewhat resembling a bow-tie. Also, the closure can be removed as easily as it was applied. One end portion such as 24 may be rounded instead of tapered to indicate that it is the other, tapered end portion 22 which has to be passed between the ribbon portions 18,20 to fasten and release the closure 10. Further, the closure is clearly of inexpensive construction.

Figure 4:
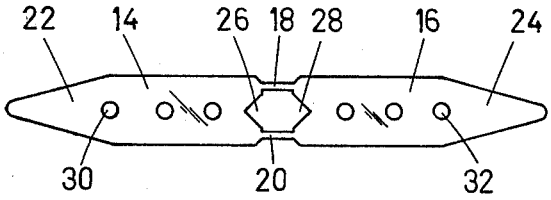
FIG. 4 is a front view of the closure at an intermediate stage in its manufacture.
Figure 5:
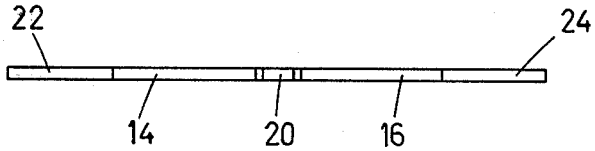
FIG. 5 is a side view of the closure in its intermediate stage.

One method of making the closure 10 will now be described with reference to FIGS. 4 and 5. Initially, a blank is stamped from a sheet of synthetic plastic material, with the shape indicated in FIGS. 5 and 6. At this stage, the ribbon portions 18,20 have a short length and a same thickness as the end portions 14,16. The closure 10 is then longitudinally stretched to elongate the ribbon portions 18,20 to about four to six times their original length, so that they reach the length shown in FIGS. 1 and 2. During this elongation process, their thickness is reduced by about one-third, so that the stretched ribbon portions 18,20 are considerably thinner than the end portions 14,16. Also, during the elongation process, the ribbon portions 18,20 become substantially molecularly oriented in the longitudinal direction, thereby increasing their strength in this direction. The end portions 14,16 are not stretched, and hence are not so molecularly oriented.

The elongation of the ribbon portions 18,20, as just described, may be achieved, for example, by mounting the end portions 14,16 on diverging conveyors which move in a direction transverse to the length of the closure 10. The conveyors may be provided with pegs which engage in the apertures 30,32 in the end portions 14,16 for this purpose.

The elongation of the ribbon portions 18,20, besides increasing their strength and resistance to deformation, also effects a saving of plastic material. With this elongation, approximately 30% to 50% more closures can be produced from the same area or weight of material. Also, with the elongation, the initial material can be about one-third thinner than it would otherwise be to provide the same closure requirements.

It will thus be seen that a closure according to the invention can be manufactured simply and inexpensively, that it can be easily attached to a bag or removed therefrom, that it securely closes the neck of the bag, and that it can be attractive in appearance.

Various modifications to the described embodiment within the scope of the invention, will be apparent to the man skilled in the art, the scope of the invention being defined in the appended claims.

What is claimed is:

1. A bag closure securable around the neck of a flexible bag, comprising an elongated strip of synthetic plastic material having opposite end portions connected by a pair of laterally spaced flexible ribbon portions, said ribbon portions each having a thickness less than the thickness of the end portions.

2. A bag closure according to claim 1 wherein the ribbon portions are substantially molecularly oriented in the direction of their length, and the end portions are randomly molecularly oriented.

3. A bag closure securable around the neck of a flexible bag, comprising an elongated strip of synthetic plastic material having opposite end portions connected by a pair of laterally spaced flexible ribbon portions, each of said end portions has a longitudinally extending series of apertures.

4. A closed bag assembly including a flexible bag having a neck and a closure secured around the neck, the closure comprising an elongated strip of synthetic plastic material having opposite end portions connected by a pair of laterally spaced flexible ribbon portions, said ribbon portions each having a thickness substantially less than the thickness of the end portions.

5. A bag assembly according to claim 4 wherein each closure end portion has a longitudinally extending series of apertures therein.

6. A closed bag assembly including a flexible bag having a neck and a closure secured around the neck, the closure comprising an elongated strip of synthetic plastic material having opposite end portions connected by a pair of laterally spaced flexible ribbon portions, said ribbon portions being molecularly oriented in the direction of their length and said end portions are randomly molecularly oriented.

* * * * *